US005115619A

United States Patent [19]

Lieder

[11] Patent Number: 5,115,619

[45] Date of Patent: May 26, 1992

[54] BAG PACKING

[75] Inventor: Gaylerd M. Lieder, Crystal, Minn.

[73] Assignee: Bemis Company, Inc., Minneapolis, Minn.

[21] Appl. No.: 691,390

[22] Filed: Apr. 25, 1991

[51] Int. Cl.[5] ..... B65B 1/34; B65B 1/12; B65B 1/46; B65B 43/30

[52] U.S. Cl. ..... 53/459; 53/468; 53/502; 53/570; 53/284.7; 53/386.1; 141/83; 141/313

[58] Field of Search ..... 53/459, 468, 469, 570, 53/502, 284.7, 384.1, 386.1, 372.5, 372.7; 141/83, 153, 234, 313

[56] References Cited

U.S. PATENT DOCUMENTS

| | | | |
|---|---|---|---|
| 2,548,222 | 4/1951 | Kindseth | 53/570 X |
| 3,058,272 | 10/1962 | Huber | 53/469 |
| 3,568,402 | 3/1971 | Lense et al. | 53/570 X |
| 3,676,977 | 7/1972 | Rothmann et al. | 53/570 X |
| 3,813,847 | 6/1974 | Kühnle | 53/570 X |
| 4,249,361 | 2/1981 | Tetenborg | 53/469 X |
| 4,561,238 | 12/1985 | Odom | 53/386.1 X |
| 4,662,409 | 5/1987 | Egli | 141/83 X |

*Primary Examiner*—Horace M. Culver
*Attorney, Agent, or Firm*—Senniger, Powers, Leavitt & Roedel

[57] ABSTRACT

A method of and apparatus for packing gusseted open-mouth bags with a fluent solid product wherein the bags are opened and filled with an initial quantity of product weighing less than the target weight, the top is reformed and the bag transported under control to a position for being topped off with the product, opened up in the latter position for being topped off, the top again being reformed and the bag transported under control to a bag closer.

20 Claims, 16 Drawing Sheets

185
29
3
167
23
47
35
33
1
8
8
189
159
15
17
25
19
31
25
13
13
PL
9
9
B
27
B
B2
7
B1
1PE
33c
21a
3
3
39
21
37
21
35
67

L1
L2
221
OFF
ON
1CRa
VC
VIBRATOR CONTROL
1VC
227
225
MCR
229
L1
L2
GND
MOTOR CONTROLLER-DC
231
115 VAC
GND
NEUT
235
233
239
COM
237
24 V DC POWER SUPPLY
TO LINE 26
245
STOP
START
243
D11
MCR
COM
241
MCR
TO LINE 35
MCR1
247
TO LINE 26
2CR
2CRA
249

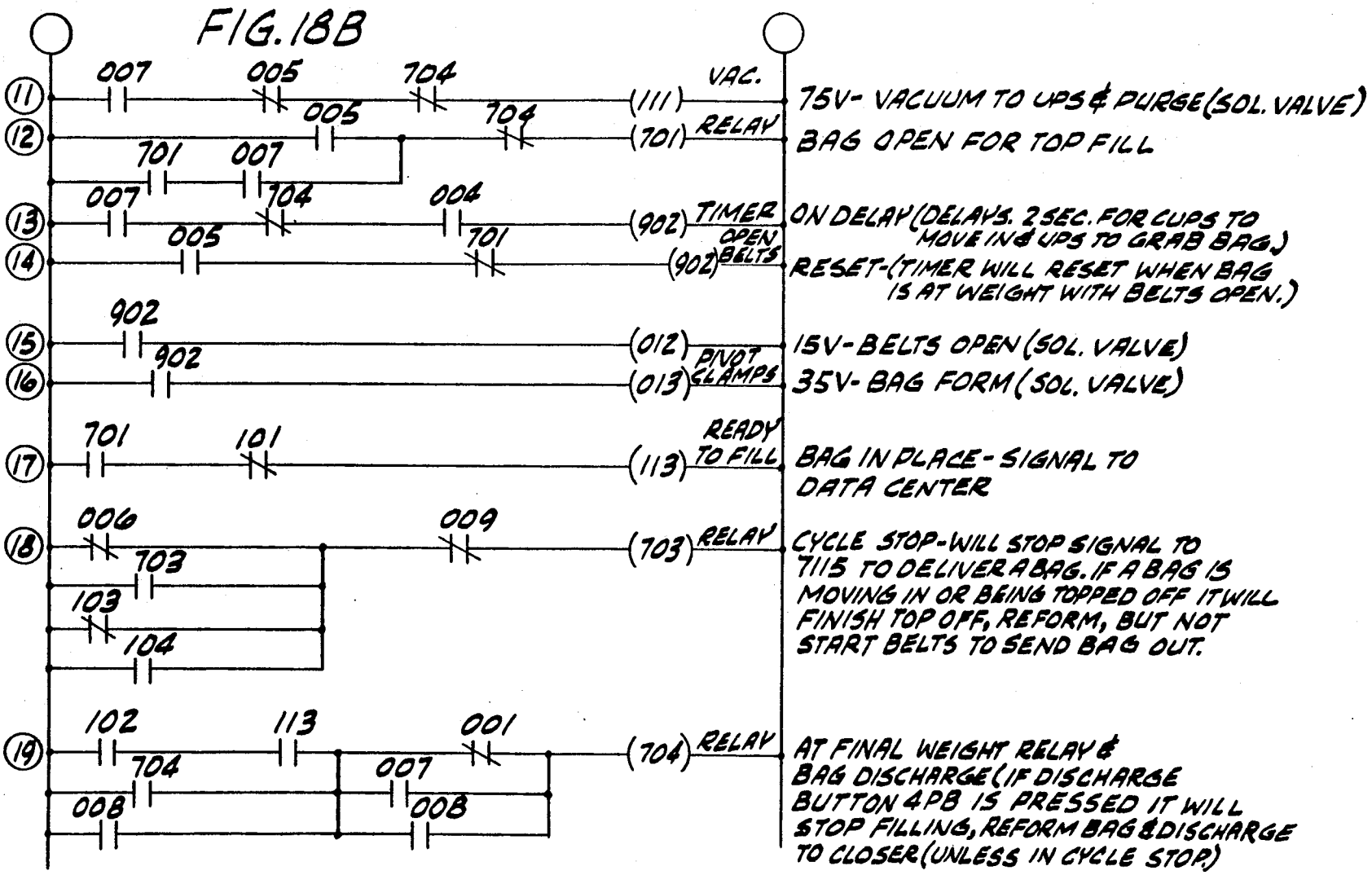
FIG. 18B
VAC.
(111)
75V- VACUUM TO UPS & PURGE (SOL. VALVE)
(701) RELAY
BAG OPEN FOR TOP FILL
(902) TIMER
ON DELAY (DELAYS. 2 SEC. FOR CUPS TO MOVE IN & UPS TO GRAB BAG.)
(902) OPEN BELTS
RESET-(TIMER WILL RESET WHEN BAG IS AT WEIGHT WITH BELTS OPEN.)
(012) 15V- BELTS OPEN (SOL. VALVE)
(013) PIVOT CLAMPS
35V- BAG FORM (SOL. VALVE)
(113) READY TO FILL
BAG IN PLACE - SIGNAL TO DATA CENTER
(703) RELAY
CYCLE STOP-WILL STOP SIGNAL TO 7115 TO DELIVER A BAG. IF A BAG IS MOVING IN OR BEING TOPPED OFF IT WILL FINISH TOP OFF, REFORM, BUT NOT START BELTS TO SEND BAG OUT.
(704) RELAY
AT FINAL WEIGHT RELAY & BAG DISCHARGE (IF DISCHARGE BUTTON 4PB IS PRESSED IT WILL STOP FILLING, REFORM BAG & DISCHARGE TO CLOSER (UNLESS IN CYCLE STOP)
007
005
704
701
007
704
005
704
005
007
701
902
902
902
701
101
006
703
103
104
102
704
008
113
001
007
008
11
12
13
14
15
16
17
18
19

BAG PACKING

BRIEF SUMMARY OF THE INVENTION

This invention relates to bag packing, and more particularly to apparatus for and methods of filling open-mouth gusseted bags with a fluent solid product such as flour.

The invention is especially concerned with a system of filling and closing open-mouth gusseted bags, among its several objects being the provision of an automated system involving auger filling in bulk as an initial mode of filling and top-off (dribble) filling as a subsequent mode of filling for accuracy of the total (target) weight of the filled and closed bag, with control over the gussets as the bag proceeds from the initial bulk filling step to the subsequent top-off step and thence to the closing step such that the gussets are maintained in their original condition. It is to be observed that problems of weight accuracy have been encountered in auger filling per se because auger filling is essentially a volumentric type of filling and which, by its nature, may effect some densification of the product being augered into the bags and cause non-uniformity of the density of the product, resulting in variations in the fill weight. In certain industries, e.g. the flour industry, the variation is not a trend but a variation from bag to bag and thus is unacceptable.

In general, the method of this invention is for packing gusseted open-mouth bags with a fluent solid product, each bag having opposed walls and gussets at the sides, the method comprising positioning an unopened bag in a first position for delivery of product into the bag by an auger filler; gripping the upper corners of the bag to hold the gussets in their original condition at the top of the bag, opening the mouth of the bag by pulling the walls of the bag apart between the gripped upper corners and moving the latter inwardly toward one another for allowing the opening of the mouth; and delivering a quantity of product into the bag weighing less than the final desired weight of product. The top portion of the bag above the level of product therein is flattened in a vertical plane extending between the walls of the bag. The grip on the upper corners of the bag is released and the bag is then moved forward in a predetermined path with its flattened top portion in said plane, stopped in a second (top-off) position for delivery of additional product for completing the filling of the bag and weighed while in said second position to determine the additional amount of product needed to complete the filling of the bag. The upper corners of the bag in the second position are gripped to hold the gussets in their original condition at the top of the bag, the mouth of the bag in the second position is opened by pulling the walls of the bag apart between the gripped upper corners and moving the latter inwardly toward one another for allowing the opening of the mouth, and said additional amount of product is delivered into the bag. The top portion of the bag above the level of product therein is flattened condition in said vertical plane; and the grip on the upper corners of the bag is released and the bag moved further forward in said path for closing its flattened top portion. In general, the apparatus of this invention comprises means for carrying out these steps.

Other objects and features will be in part apparent and in part pointed out hereinafter.

BRIEF DESCRIPTION OF THE DRAWINGS

FIG. 18B is a continuation of FIG. 18A.

Corresponding reference characters indicate corresponding parts throughout the several views of the drawings.

DETAILED DESCRIPTION

Figure 1:
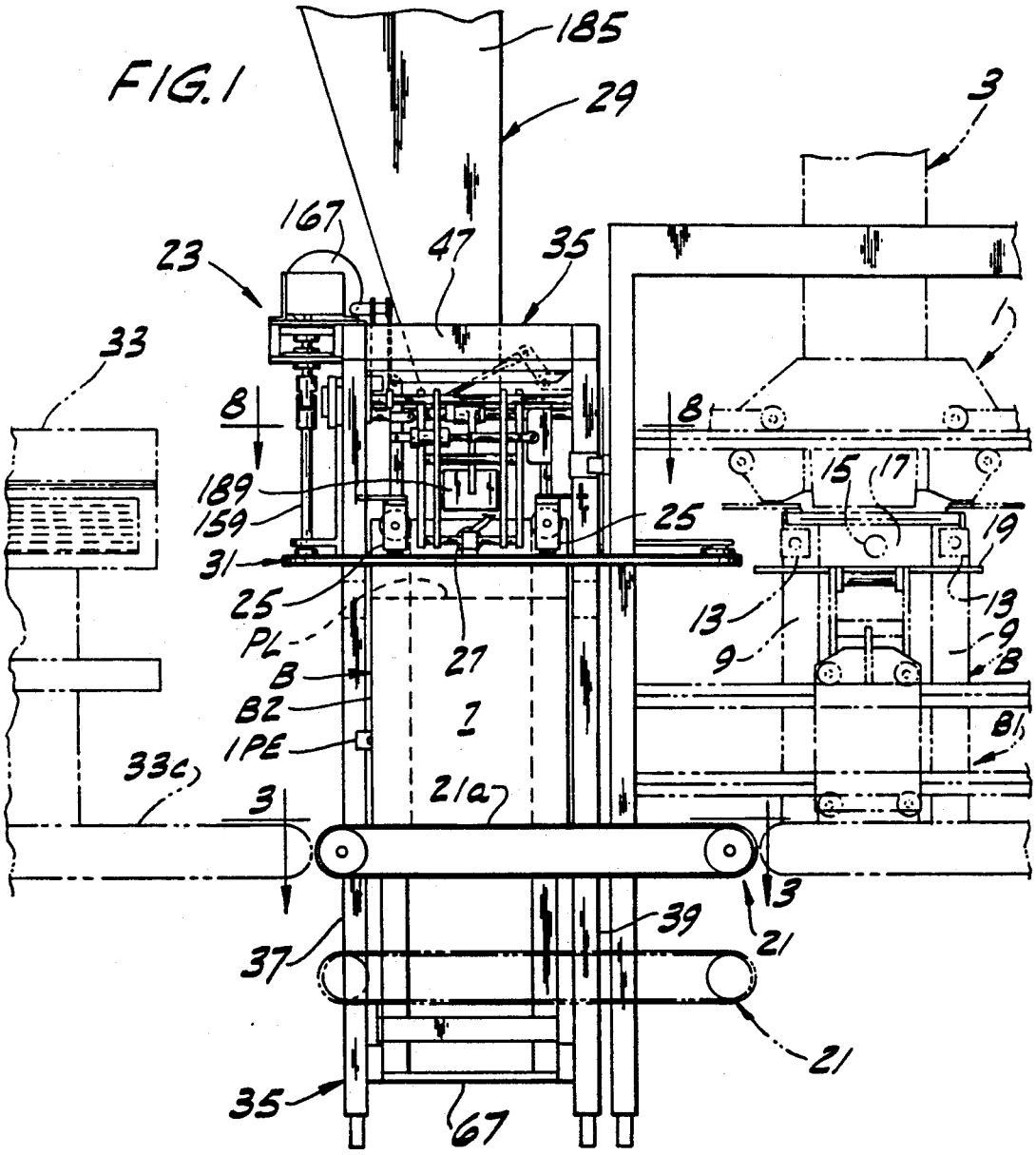
FIG. 1 is a diagrammatic side elevation of apparatus of this invention.
Figure 2:
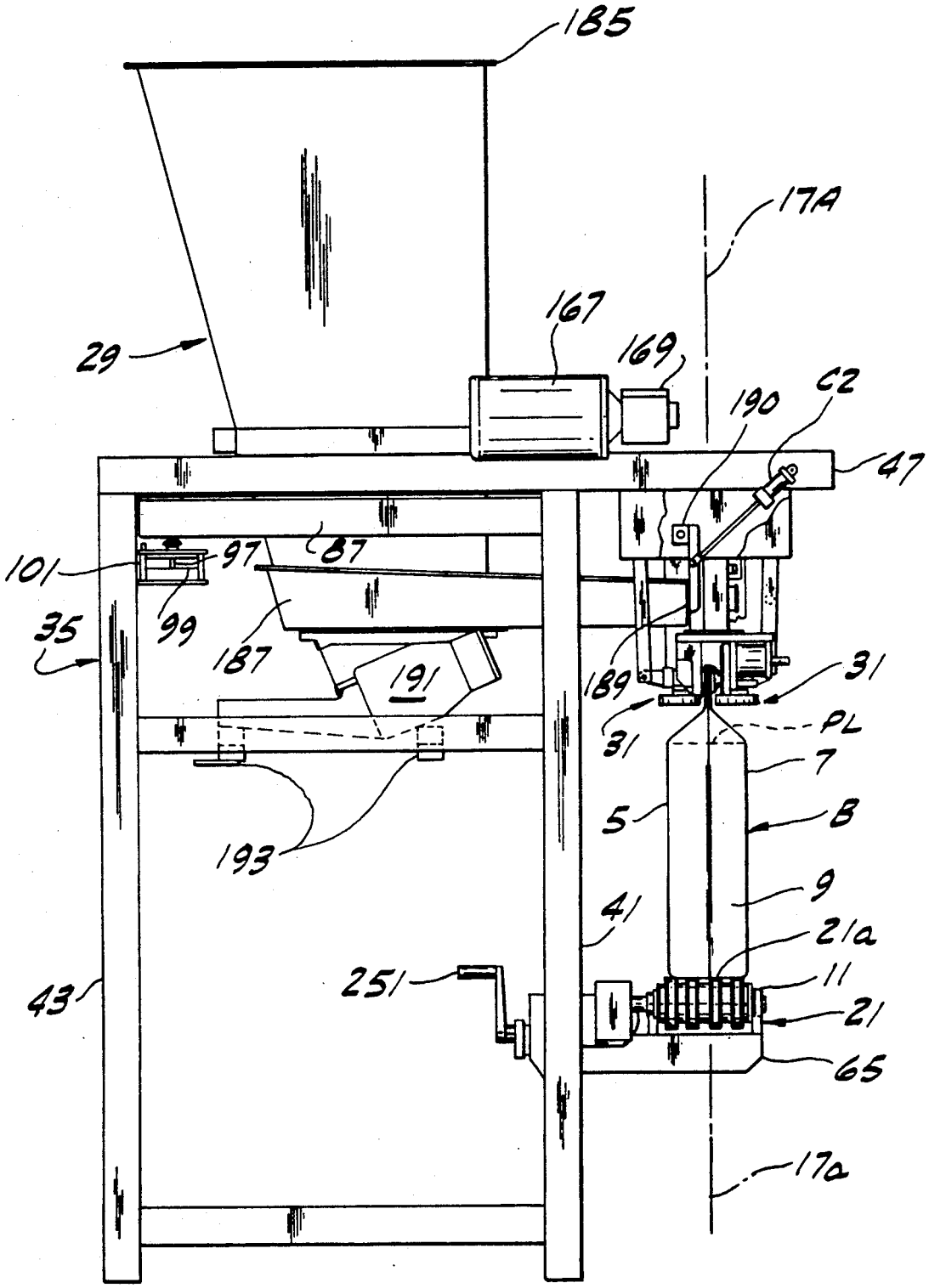
FIG. 2 is an end elevation as viewed from the left of FIG. 1.
Figure 3:
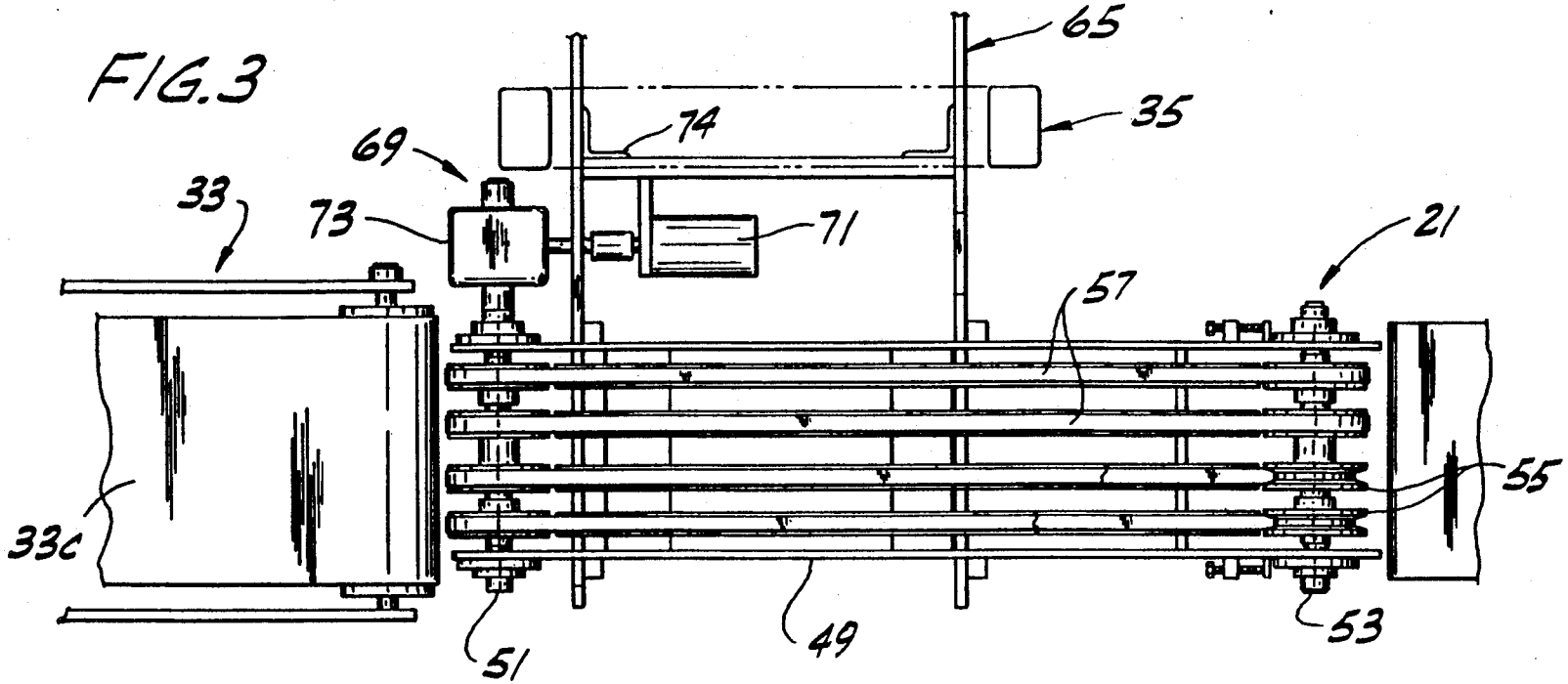
FIG. 3 is a plan of a belt conveyor of the apparatus as viewed on line 3—3 of FIG. 1.
Figure 4:
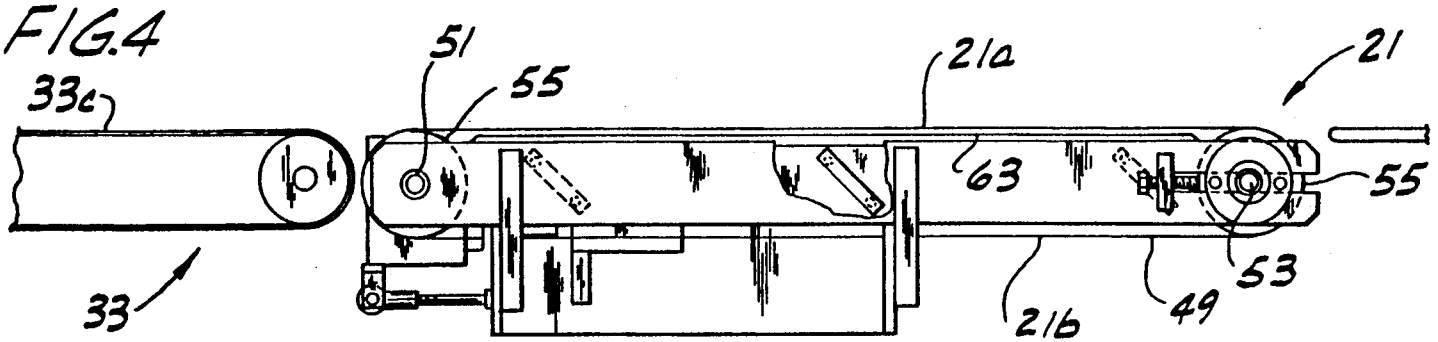
FIG. 4 is a side elevation with parts broken away of the belt conveyor.
Figure 5:
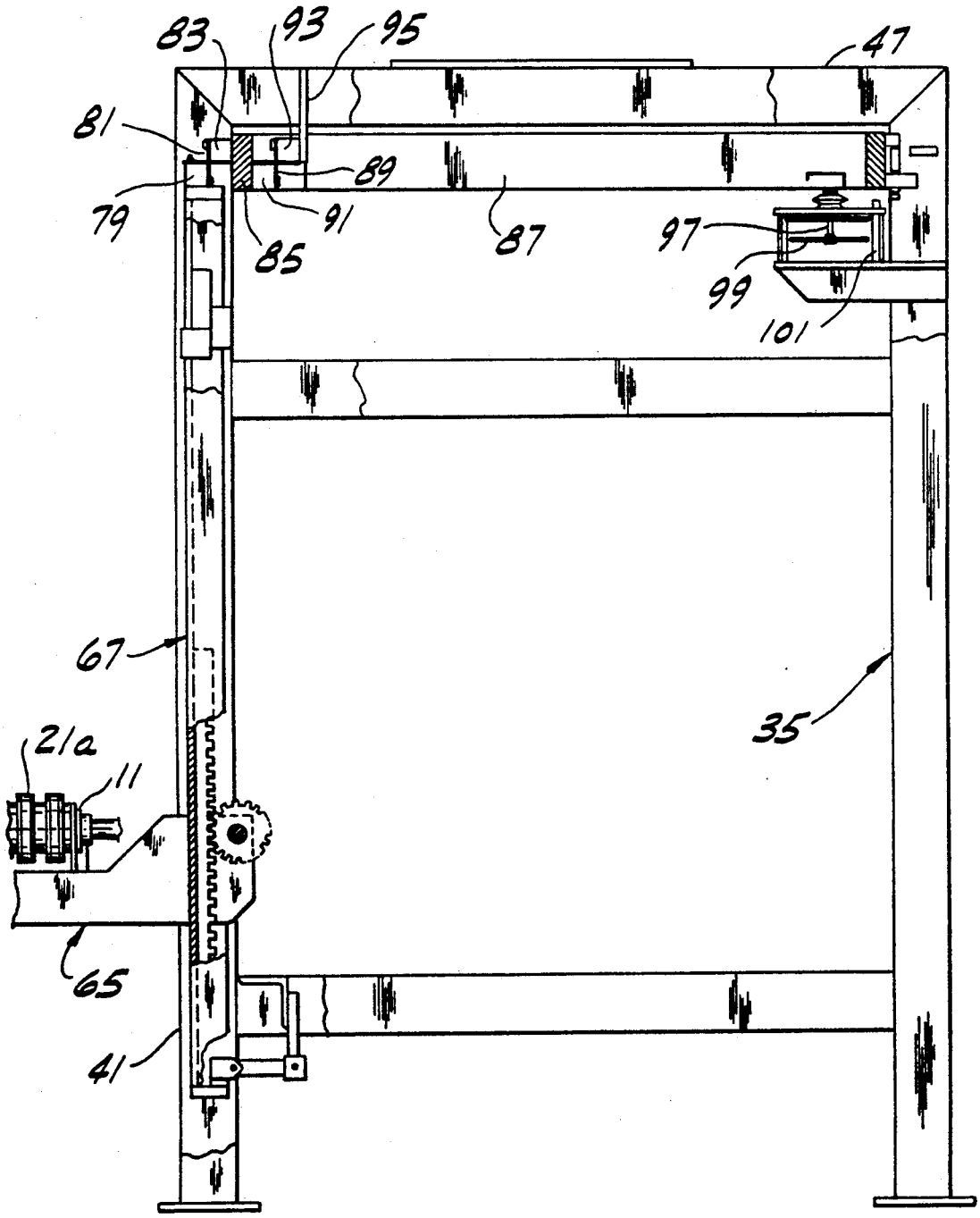
FIG. 5–7 are views illustrating the weigh system of the apparatus.
Figure 6:
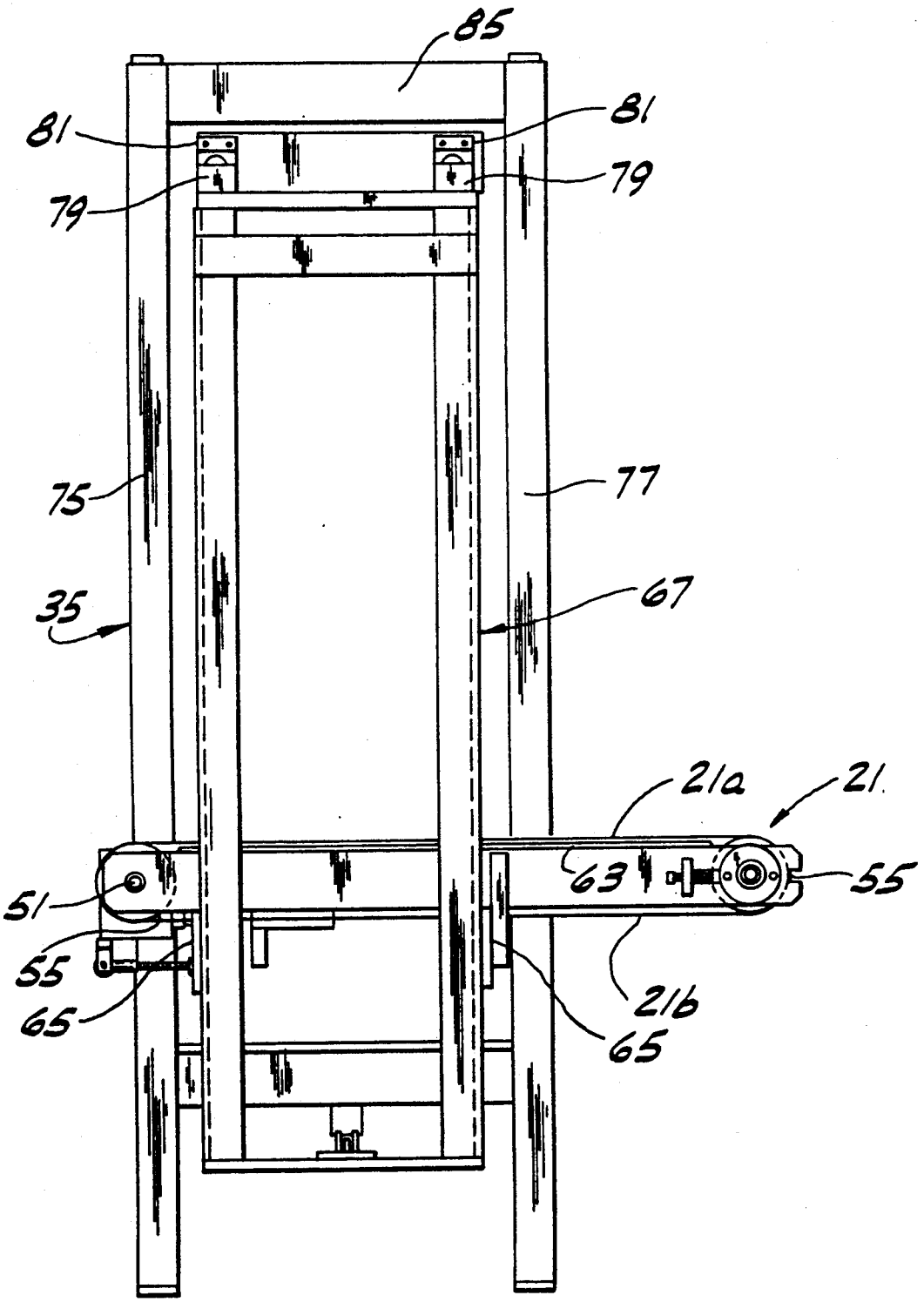
Figure 7:
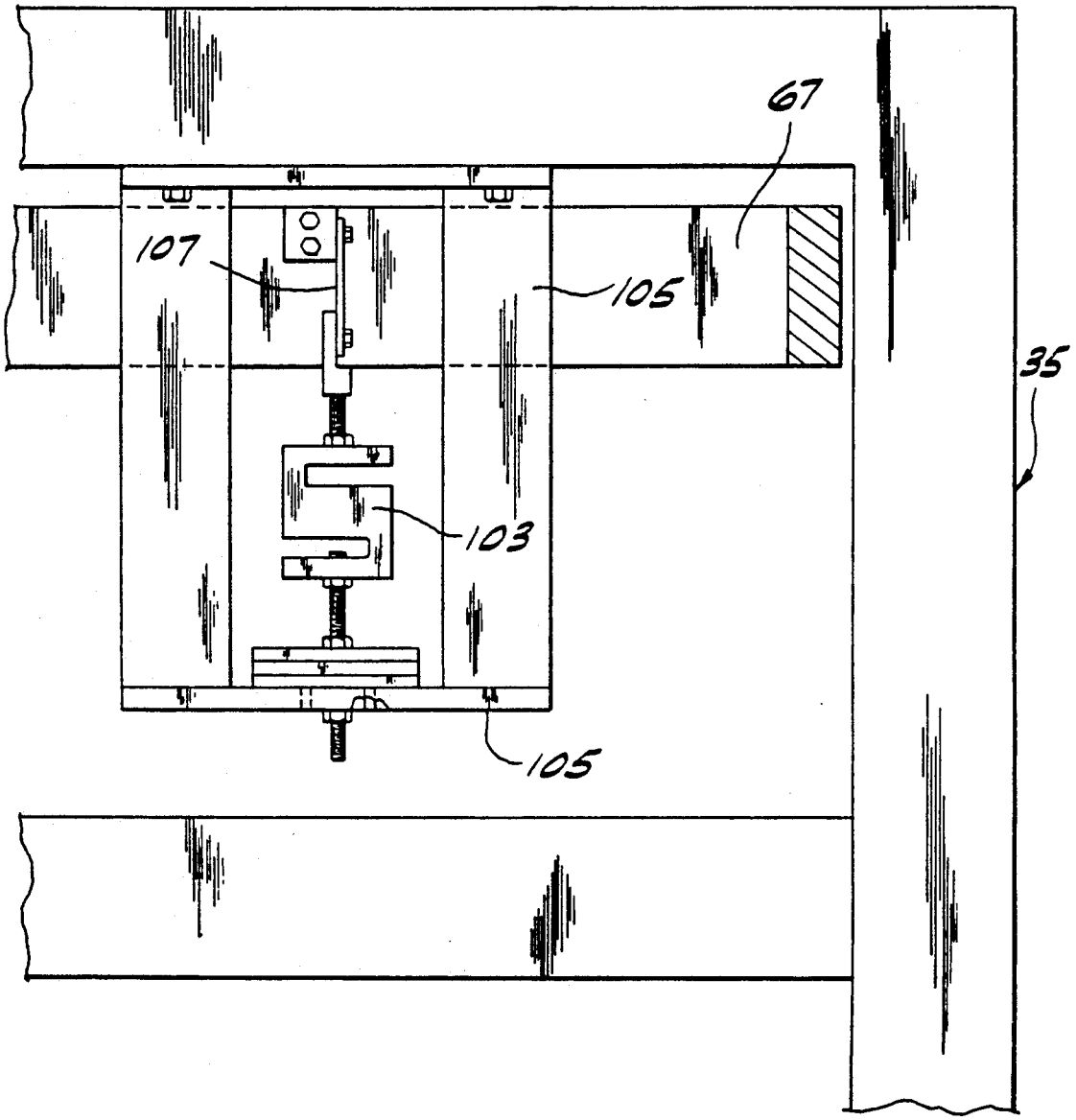

Referring first to FIGS. 1 and 2 for a preliminary description of the method are apparatus of this invention, there is indicated at 1 a first filling station at which an unopened gusseted open-mouth bag B is brought from a stack of bags to a first position B1 wherein the bag is upright for delivery of product (e.g. flour) into the bag by an auger filler indicated generally at 3. The bag B has opposed walls 5 and 7 (front and back walls), gussets 9 at the sides, a bottom closure 11, and is open at the top. At station 1 the upper corners of the bag are gripped by grippers indicated generally at 13 to hold the gussets 9 in their original condition at the top of the bag. The mouth of the bag is opened by pulling the walls 5 and 7 apart by vacuum grippers (vacuum cups) as indicated at 15 between the gripped upper corners, and moving the corner grippers 13 inwardly toward one another for allowing the opening of the mouth. A quantity of product weighing less than the final desired weight of product is delivered into the bag by the auger filler 3. The top portion of the bag above the level of product therein is flattened as indicated at 17 a vertical plane 17A extending centrally between the spread-apart lower portions of the bag walls 5 and 7. The vacuum cups 15 are released and the corner grippers 13 are moved outwardly away from one another to a spread-apart position for this purpose, ultimately being opened. Also, the flattening is promoted by moving a pair of gripper members indicated at 19 inwardly from a spreadapart position into engagement with the bag walls between the product level and the corner grippers. The bag, with the fill of product therein delivered by the auger filler and with its top portion flattened as indicated at 17 is then moved forward (toward the left as viewed in FIG. 1) in a predetermined linear path with its flattened top portion 17 in plane 17A.

As so far described, the apparatus and the method of operation are in principle the same as the apparatus and method of operation disclosed in U.S. Pat. No. 4,561,238 of Robert E. Odom, issued Dec. 31, 1985 to Bemis Company, Inc. of Minneapolis, Minnesota (assignee of this invention), with the difference that an auger filler, which may be a conventional auger filler, is used. Reference may be made for details to said U.S. Pat. No., which is incorporated herein by reference. The corner grippers herein indicated at 13 correspond to the clamp means 170, 173 shown in said patent, the vacuum cups herein indicated at 15 correspond to those indicated at 215 in said patent, and the elongate gripper members herein indicated at 19 correspond to the gripper means of said patent which includes gripper member 311.

The bag B, moving forward from station 1, is transferred to the upper reach 21*a* of an endless belt conveyor 21 which is adapted to move the bag farther forward, the conveyor 21 stopping to stop the bag in a second position in a trim weigh or "top-off" unit indicated in its entirety by the reference numeral 23 defining a second filling station, for delivery of additional product ("trim") for completing the filling of the bag, as will appear. The conveyor constitutes the platform of a weighing scale system which functions to weigh the bag while in the stated second or "top-off" position B2 to determine the additional amount of product needed to complete the filling of the bag. To accomplish this, the upper corners of the bag at position B2 are gripped by grippers indicated generally at 25 to hold the gussets in their original condition at the top of the bag. The mouth of the bag is opened by pulling the walls 5 and 7 of the bag apart by vacuum grippers (vacuum cups) as indicated at 27 between the gripped upper corners and moving the corner grippers inwardly toward one another for allowing the opening of the mouth. The additional amount of product needed to top off the original quantity of product delivered into the bag to reach the target weight is delivered into the bag by a product delivery means indicated at 29. The bag is then released and the top portion of the bag above the level of product therein is allowed to resume its flattened condition in the stated vertical plane 17A. The vacuum cups 27 are released and the corner grippers 25 are moved outwardly away from one another (spread apart) to their spread-apart position of FIG. 1 for this purpose, ultimately being opened. Also, the flattening of the top of the bag is promoted by moving a pair of endless belts each designated 31 inwardly from a spread-apart position for engagement of the inner reaches 31*a* of the belts with the bag walls between the product level PL (see FIGS. 1 and 2) and the corner grippers 25. The bag, with the topped-off fill of product and with its top portion flattened as indicated at 17 is then moved forward (toward the left as viewed in FIG. 1) in the aforesaid plane or path 17A for closure of its flattened top portion closure by closing means such as indicated at 33 in FIG. 1. For the closure of open-mouth pinch bottom bags, having hot melt adhesive for effecting closure, the closing means may be of a well-known type having means for heating the adhesive and folding over the top of the bag. For closure of sewn open-mouth bags, the closing means may comprise suitable well-known bag top sewing apparatus (which may include tape-applying means).

The trim weigh or top-off unit 23 comprises a main frame generally designated 35 having a leading side 37 and a trailing side 39 ("leading" and "trailing" being in respect to travel if the bags relative to the frame), and a front side 41 and a rear side 43 "front" and "rear" being in respect to the path of travel of the bags which is in the vertical plane 17A. The main frame 35 has a top or head structure 47 cantilivered out from the stated front side 41 above the path of the bags, i.e., above the belt conveyor 21. The latter comprises an elongate framework 49 having shafts 51 and 53 at its leading and trailing ends, respectively, extending transversely across the framework, these shafts carrying pulleys 55 with endless belts 57 trained around the pulleys defining the forwardmoving upper reach 21*a* and a lower return reach 21*b*. Four belts are shown, the framework having means for supporting their upper reaches indicated at 63. The conveyor is mounted in position extending longitudinally of the apparatus below the contilevered head structure 47 with the vertical central longitudinal plane of the conveyor, which defines the plane or path 17A of the bags on a bracket structure 65 which extends out from the front 41 of frame 35. The bracket structure is carried by a subframe 67, which may be referred to as the weigh frame. Means for driving the conveyor belts 57 indicated generally at 69 comprises an air motor 71 and a speed reducer 73, these components being mounted as indicated at 74 for movement with the conveyor framework 49.

The weigh frame 67 extends generally vertically in the space between posts 75 and 77 of the main frame at the front of the apparatus, being connected at its upper end by means of blocks 79 to cruciform spring link members 81. The latter are connected by a block 83 to a member 85 at one end of an arm 87, which may be referred to as the weigh arm. Cruciform spring links 89 are secured by a block 91 to the member 85 and by a block 93 to a bracket 95 which extends down from the top of the main frame. The arm 87 extends across the main frame, having its free end supported by the upper end of piston rod 97 extending from the piston 99 of a dashpot cylinder 101. A strain gage 103 is connected as indicated at 105 to the main frame and at 107 to the weigh arm 87. The arrangement is such that the weight of a bag on the conveyor 21 causes a deflection of the weigh arm 87 resulting in strain of the strain gage 103 as a measure of the weight of the arm in addition to strain caused by the weight of the conveyor 21 weigh frame 67 and parts carried by the weigh frame as will appear, and the weigh arm.

Figure 14:
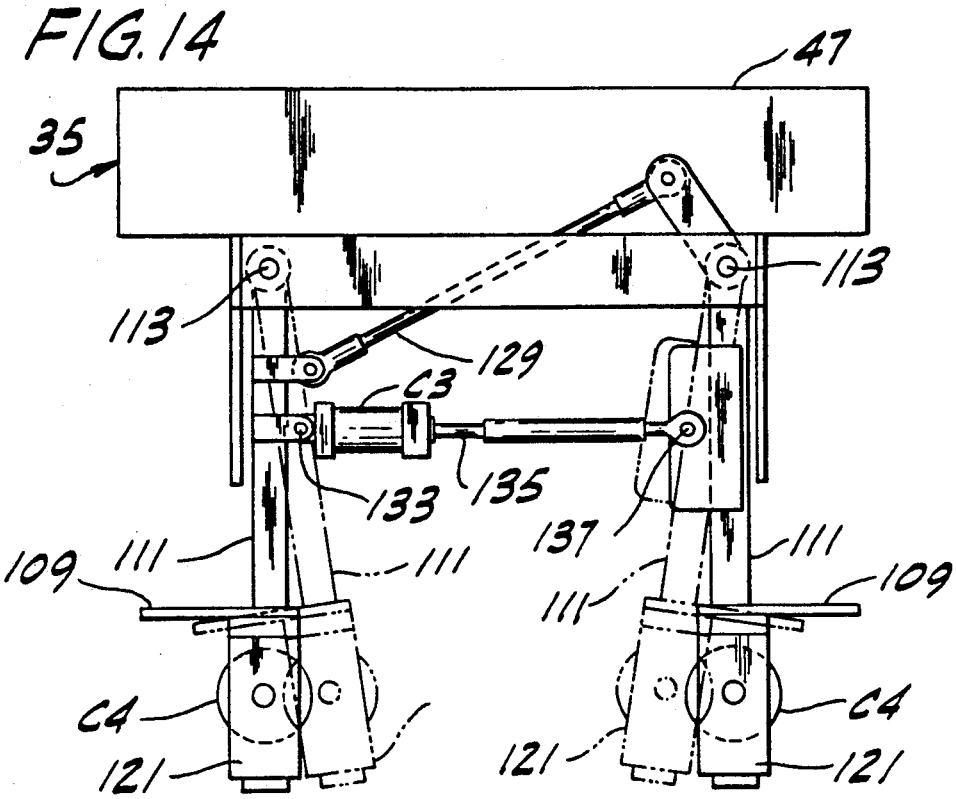
FIG. 14 is a side elevation of bag corner gripper means of the apparatus.

As above noted, a bag B having been filled by the auger filler 3 at station 1 with the quantity of product less than the target weight and transferred to the conveyor 21, is moved forward by the conveyor 21 to the position B2 in the top-off unit 23 in which it is shown in FIGS. 1 and 2 under the overhanging part of the head 47 of the main frame 35 of the top-off unit. The conveyor 21 stops with the bag in this position B2, which may be referred to as the top-off position. Here the flattened top portion 17 of the bag, as formed in the main filling unit 1 (the auger filling unit) extends up between the inner reaches 31*a* of the upper gripper belts 31, between the vacuum cups 27, and into the corner grippers 25, all of these instrumentalities being open at this time. Each corner gripper 25 (see particularly FIGS. 14 and 15) comprises a plate 109 mounted at the lower end of an arm 111 pivotally mounted as indicated at 113 for swinging movement in the plane 17A of the path of the bags about a horizontal axis which extends at right angles to said plane on a bracket 115 extending forward from the weigh frame 67 at the top of the latter. Extending down from the plate 109 at the rear of the plate and fixed thereto is a rear gripper jaw 117. Extending down from the plate 109 adjacent the front of the plate are two spaced plates 119 and 121 mounting an air cylinder C4 with its axis at right angles to the plane 17A, and having a piston rod 123 extending from its rear end carrying a movable gripper jaw 125 opposed to the fixed jaw 117. A guide rod 127 extends forward from the jaw 125 through a hole in the plate 119. The gripper arms 111 are interconnected by a linkage indicated at 129 for effecting swinging of the arms in unison between a spread-apart position wherein the grippers are located as indicated in FIGS. 1 and 14 for gripping the corners of the bag with the flattened top portion 17 at position B2 to a position wherein the arms 111 are convergent toward one another as illustrated in phantom in FIG. 14 and the corner grippers are closer together. Means for swinging the arms 111 on their pivots 113 is shown to comprise an air cylinder C3 having its head end pivotally connected to one of the arms as indicated at 133 and its piston rod 135 pivotally connected to the other arm as indicated at 137.

Figure 12:
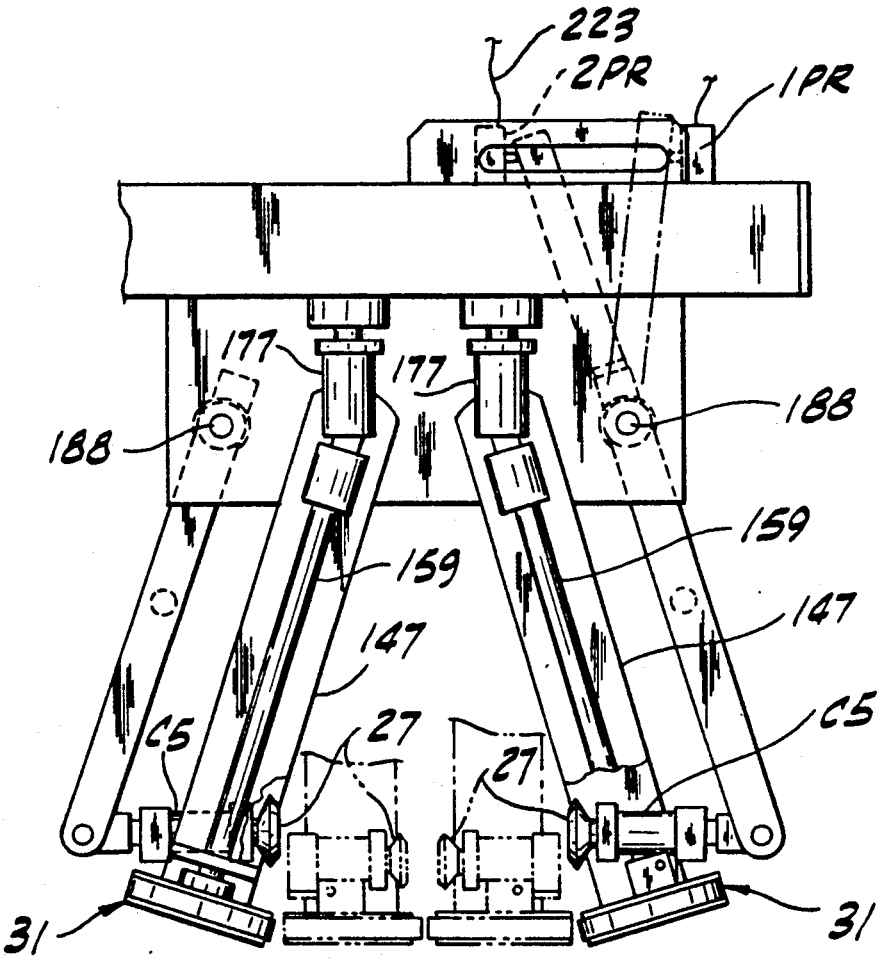
FIG. 12 is a view similar to FIG. 11 with parts broken away showing how the vacuum cups are retracted and then swung out with the upper belts.
Figure 13:
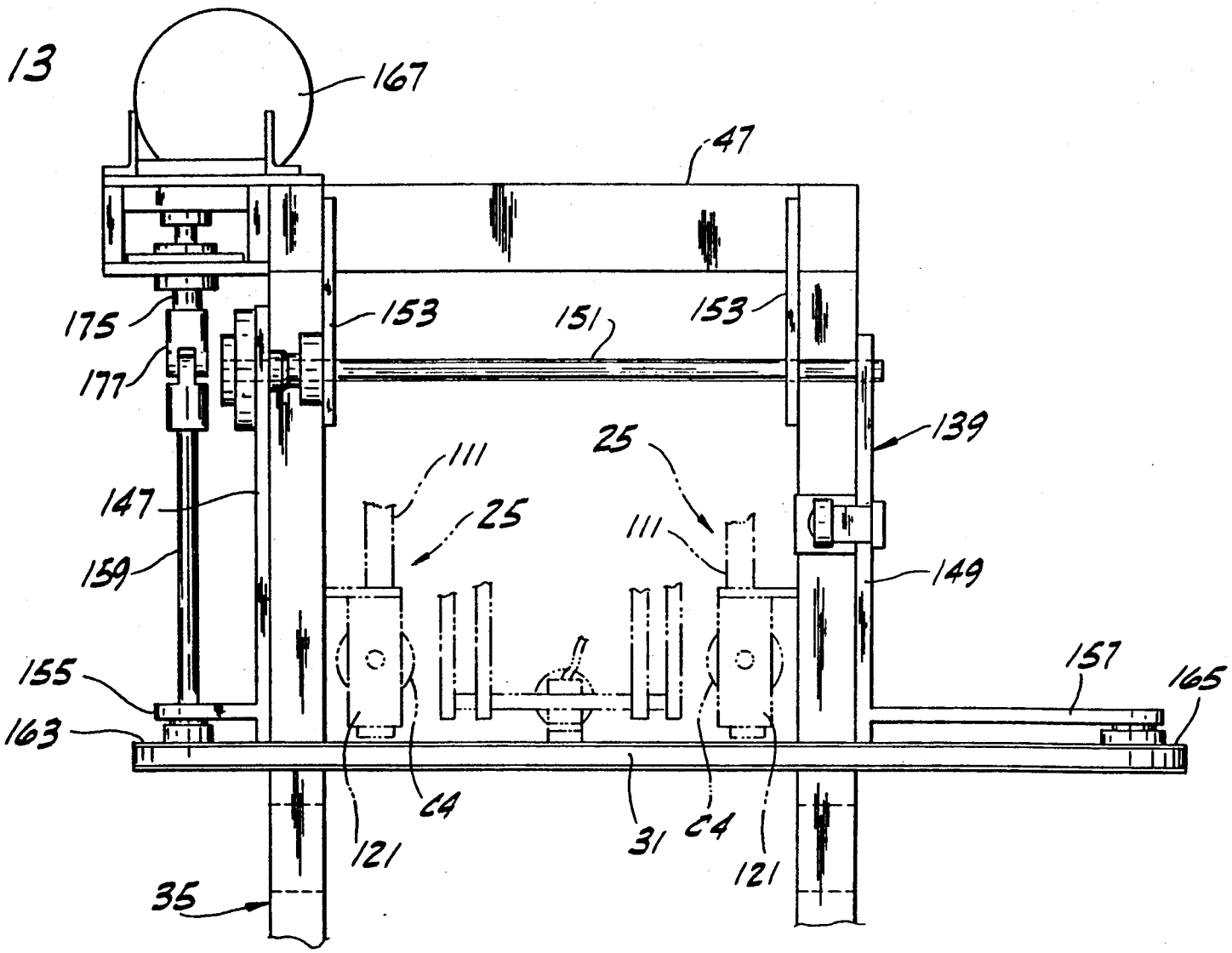
FIG. 13 is a side elevation of FIG. 11 showing certain bag corner grippers and vacuum cups means in phantom.

Each of the upper belts 31 is carried by a swinging frame generally designated 139 comprising a pair of arms 147 and 149 pivoted at their upper ends by means of a shaft 151 mounted as indicated at 153 in the main frame, with a crossbar 154 spanning the lower ends of the arms. Arm 147 has a relatively short finger 155 extending laterally outwardly adjacent its lower end and arm 149 has a relatively long finger 157 extending laterally outwardly adjacent its lower end. A relatively long shaft 159 journalled in finger 155 and a short stub shaft 161 journalled in finger 157 have pulleys 163 and 165, respectively, keyed thereon. The long shaft is driven by an electric motor 167 mounted on top of the main frame, driving the input of a right-angle speed reducer 169, the output 171 of the latter being geared as indicated at 173 to a shaft 175 coupled to the upper end of the long shaft by a universal joint 177 permitting swinging of the arms 147 and 149 to swing the belts 31 toward and away from one another. The drive is such that the inner opposed reaches 31*a* of the belts move forward, the outer reaches 31*b* returning rearward. The arms 147 and 149 are swingable in and out to swing the inner reaches 31*a* of the belts 31 from an open position solid lines in FIG. 12 to a closed position (dotted lines in FIG. 12) engaging the top portion 17 of a bag in the top-off position B2 between the level of product in the bag and the corner grippers 25 by an air cylinder C1 pivotally connected at its head end to one of the arms 149 as indicated at 179 and having its piston rod pin-connected as indicated at 181 to the other arm.

These are two vacuum cups 27, one situated to the rear and the other to the front of the plane 17A. Each vacuum cup is mounted on the end of the piston rod of an air cylinder C5 pivoted as indicated at 182 on the lower crossbar 154 of a respective frame 139. The cylinders C5 are maintained horizontal as the frames 139 swing in and out by means of links 184 constituted by frames pivotally interconnected at their lower ends as indicated at 186 with the cylinders C5 and pin-connected at their upper ends as indicated at 188.

Figure 8:
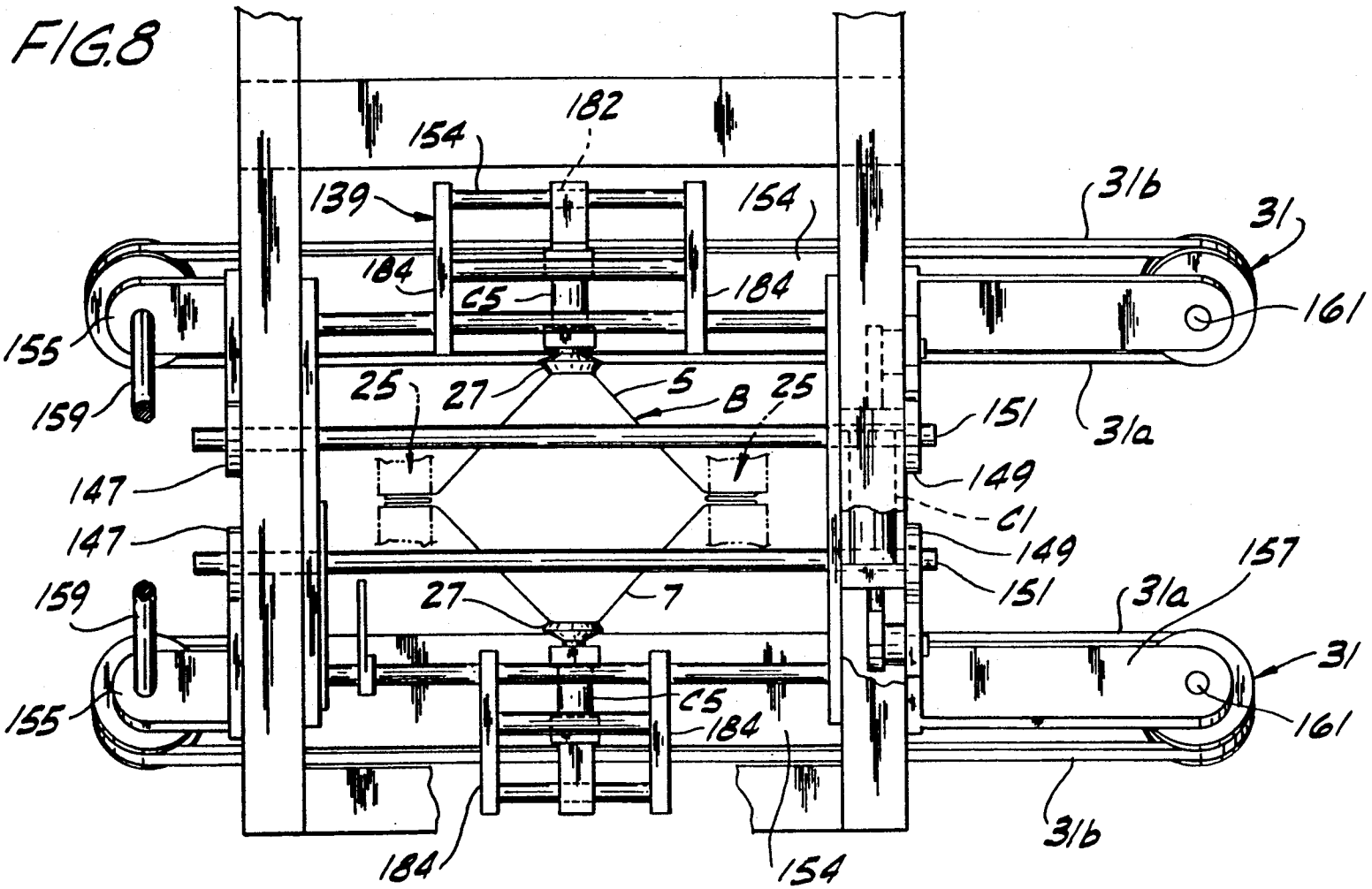
FIG. 8 is an enlarged view generally on line 8—8 of FIG. 1 with parts broken away and showing certain bag mouth vacuum cups having pulled the bag mouth open.
Figure 10:
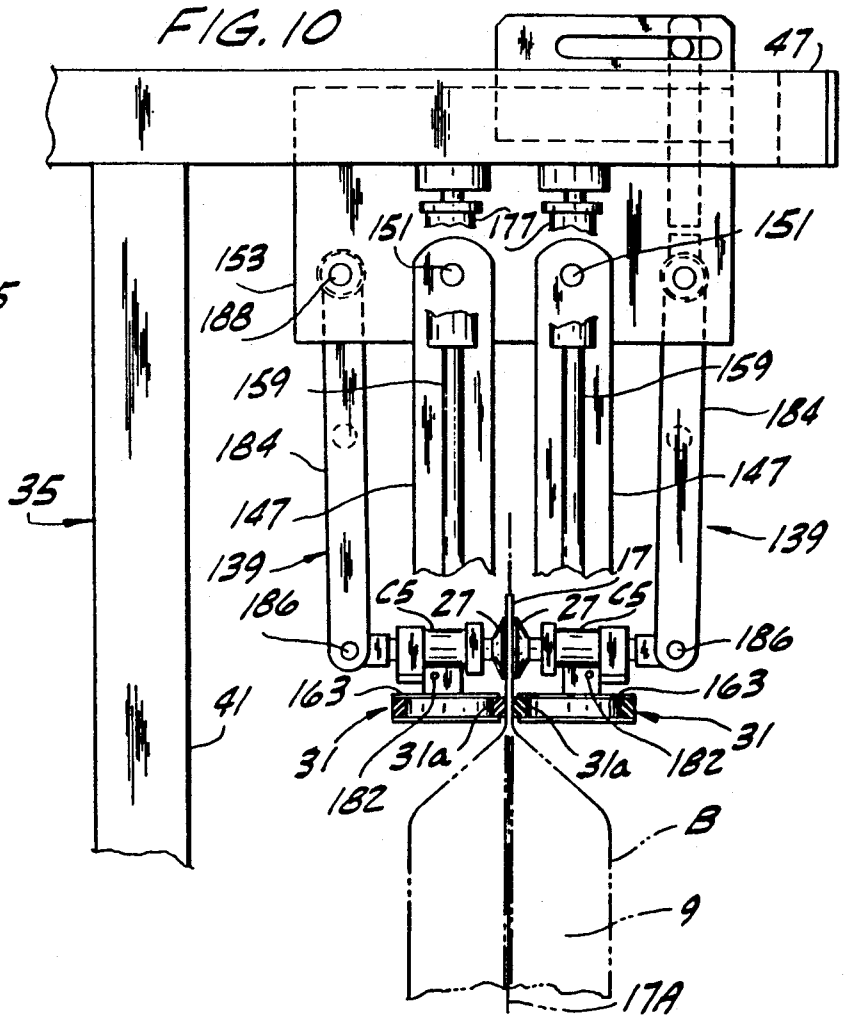
FIG. 10 is an enlarged fragment of FIG. 2, with parts broken away and shown in section, showing the vacuum cups as initially brought into engagement with the opposite sides of the flattened top portion of the bag.
Figure 9:
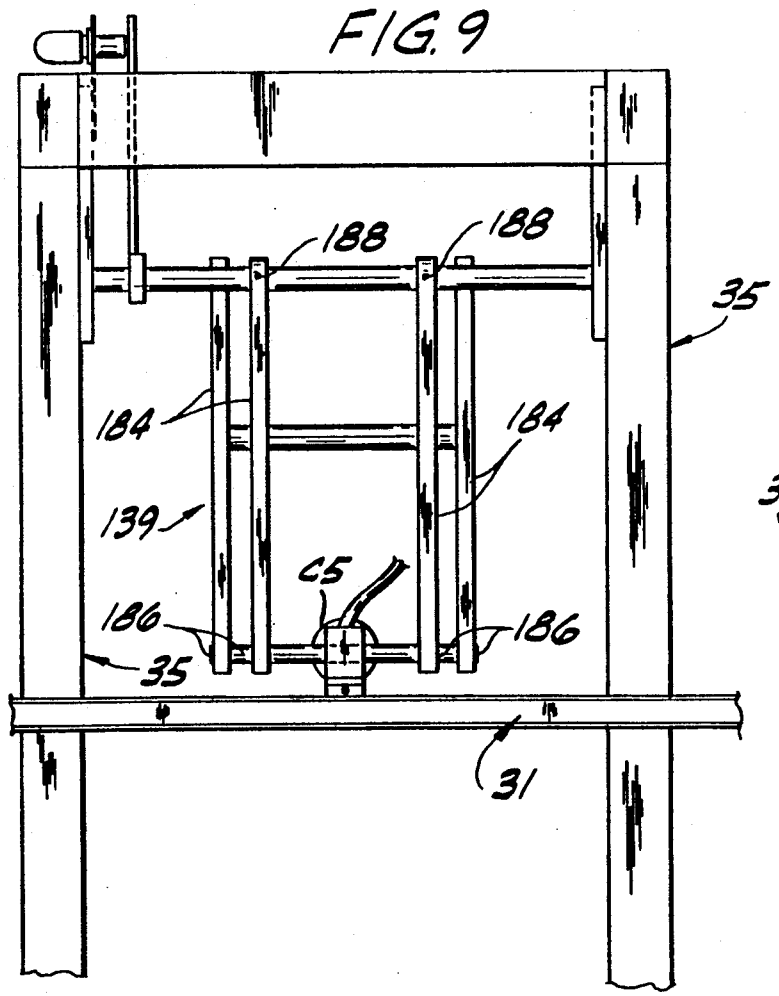
FIG. 9 is a view of certain framework carrying the vacuum cups.
Figure 11:
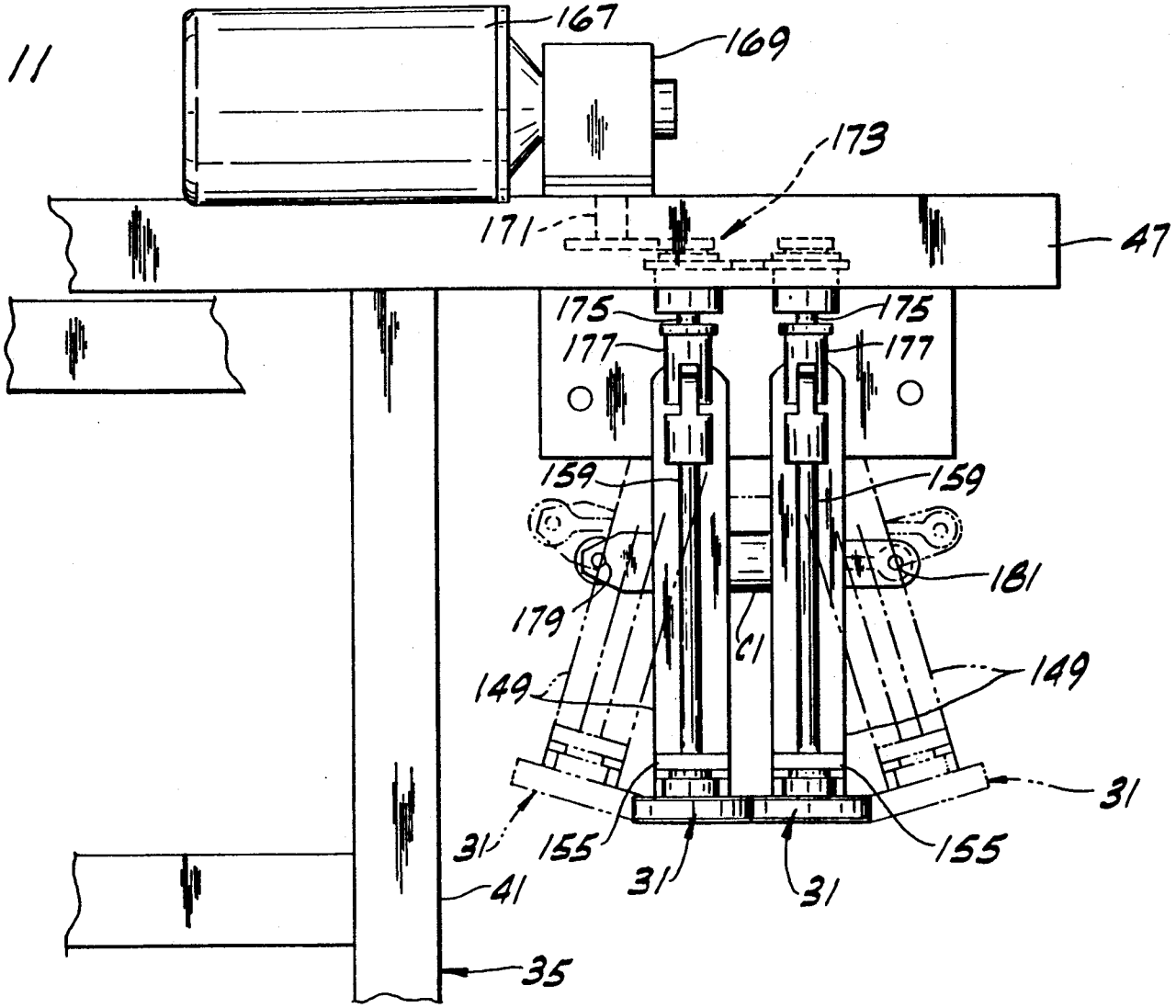
FIG. 11 is a view similar to FIG. 10 showing the drive for certain upper belts of the apparatus, showing in phantom these belts swung open.

With a bag B from the auger filling 1 stopped in position B2 in the top-off filling unit 23, grippers 25 are actuated to grip the top corners of the bag, and the vacuum cups 27 are moved into position to vacuum grip the walls of the bag adjacent the bag top, and then moved out to pull open the bag mouth (see FIG. 8). The corner grippers are swung toward one another as the mouth opens retaining their grip on the corners. With the bag mouth open, the quantity of product required for bringing the weight of the bag up to the target weight, as determined by the weighing system, is delivered into the bag by the product feed means 29. As shown herein, this feed means is a vibratory feeder comprising a hopper 185 for holding a supply of product and delivering product to a trough 187 which is mounted in the main frame extending forward with its forward end disposed (in respect to the opened mouth of the bag) for product exiting from the trough to drop into the bag. A gate 189 is provided for closing the delivery end of the trough to shut off delivery of product, the gate being pivoted as indicated at 190 and opened and closed by an air cylinder C2. An electric vibrator motor 191 is provided at the bottom of the trough for vibrating the trough, the motor being mounted in the main frame on suitable vibratory supports as indicated at 193.

Figure 16:
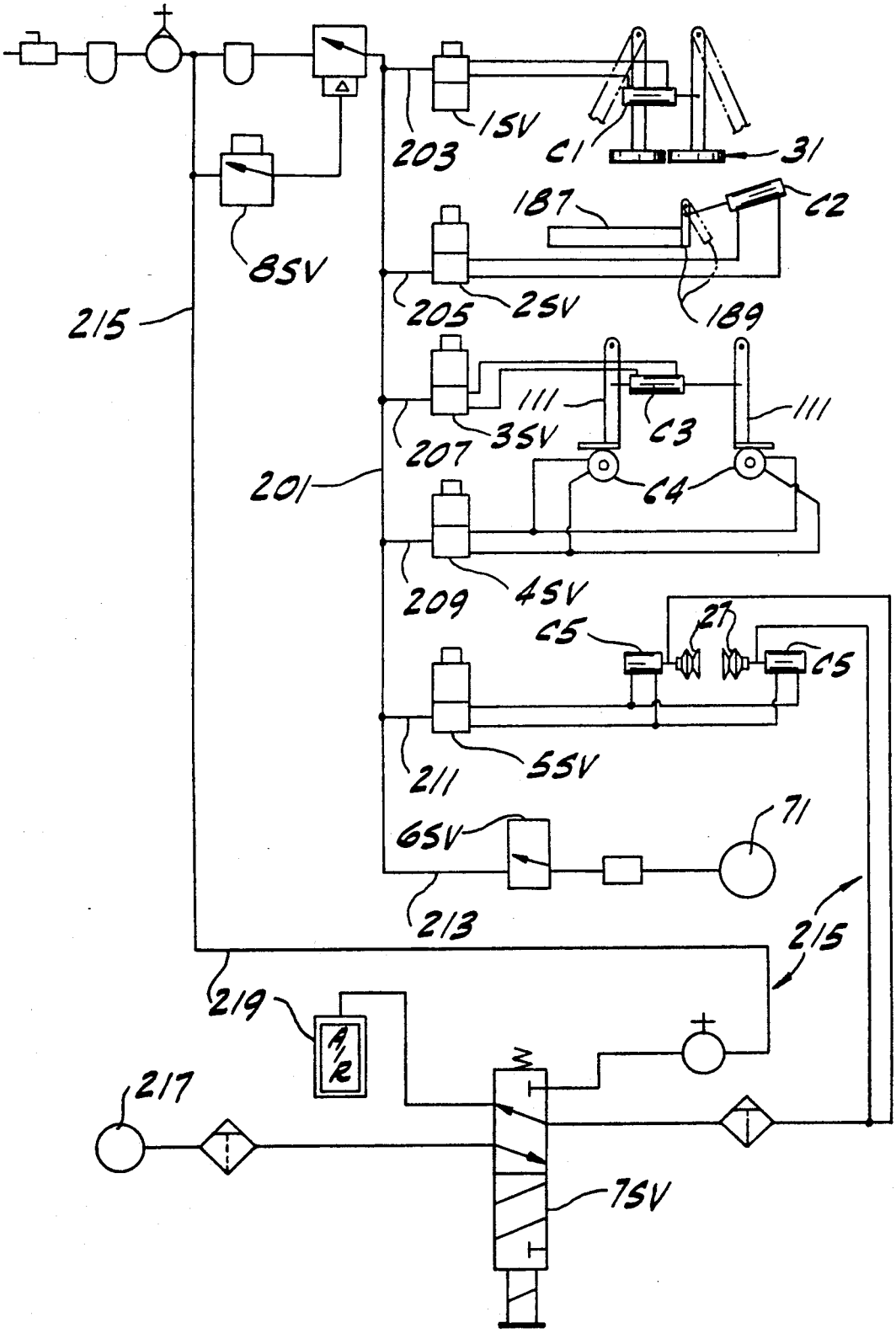
FIG. 16 is a schematic diagram of the pneumatic circuitry of the apparatus.

Referring to FIG. 16, there is indicated at 201 a compressed air supply line suitably supplied with air under pressure and connected as indicated at 203 for operating the cylinder C1 for the arms 149 for the belts 31 under control of a solenoid valve 1SV; connected as indicated at 205 for operating the cylinder C2 for the cut-off gate of the vibratory feeder under control of a solenoid valve 2SV; connected as indicated at 207 for operating the cylinder C3 for the corner gripper arms 111 under control of a solenoid valve 3SV; connected as indicated at 209 for operating the corner gripper cylinders C4 under control of a solenoid valve 4SV; connected as indicated at 211 for operating the cylinders C5 for moving the vacuum cups 27 in and out under control of a solenoid valve 5SV; and connected as indicated at 213 for operating the air motor 71 for the conveyor 21 under control of a solenoid valve 6SV. At 215 is indicated a vacuum system including a vacuum pump 217 and a solenoid valve 7SV for pulling a vacuum in the vacuum cups 27 and at 219 is indicated a system for dumping air under control of a solenoid valve 8SV.

Figure 17:
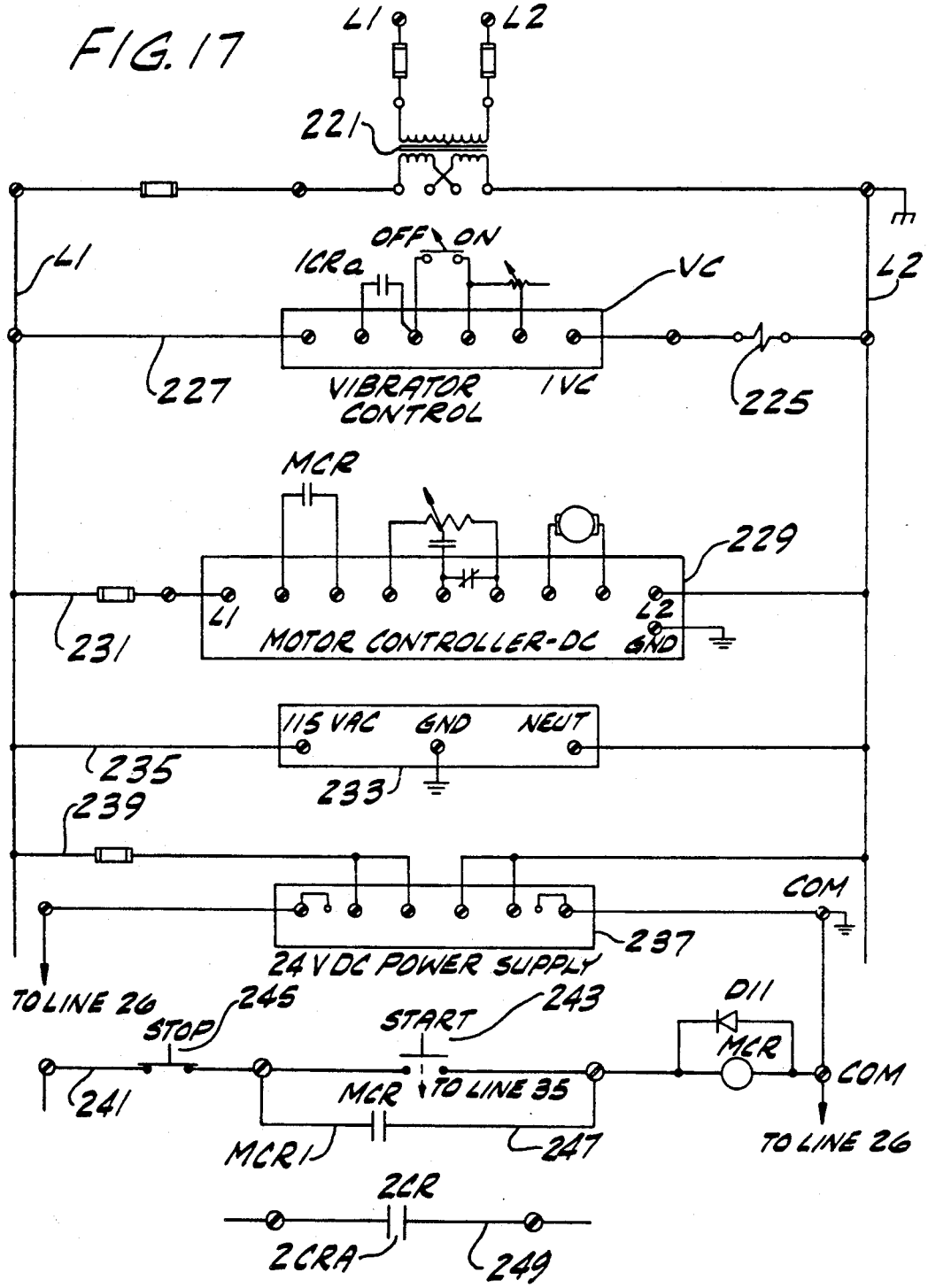
FIG. 17 is a schematic diagram of certain electrical circuitry.
Figure 18A:
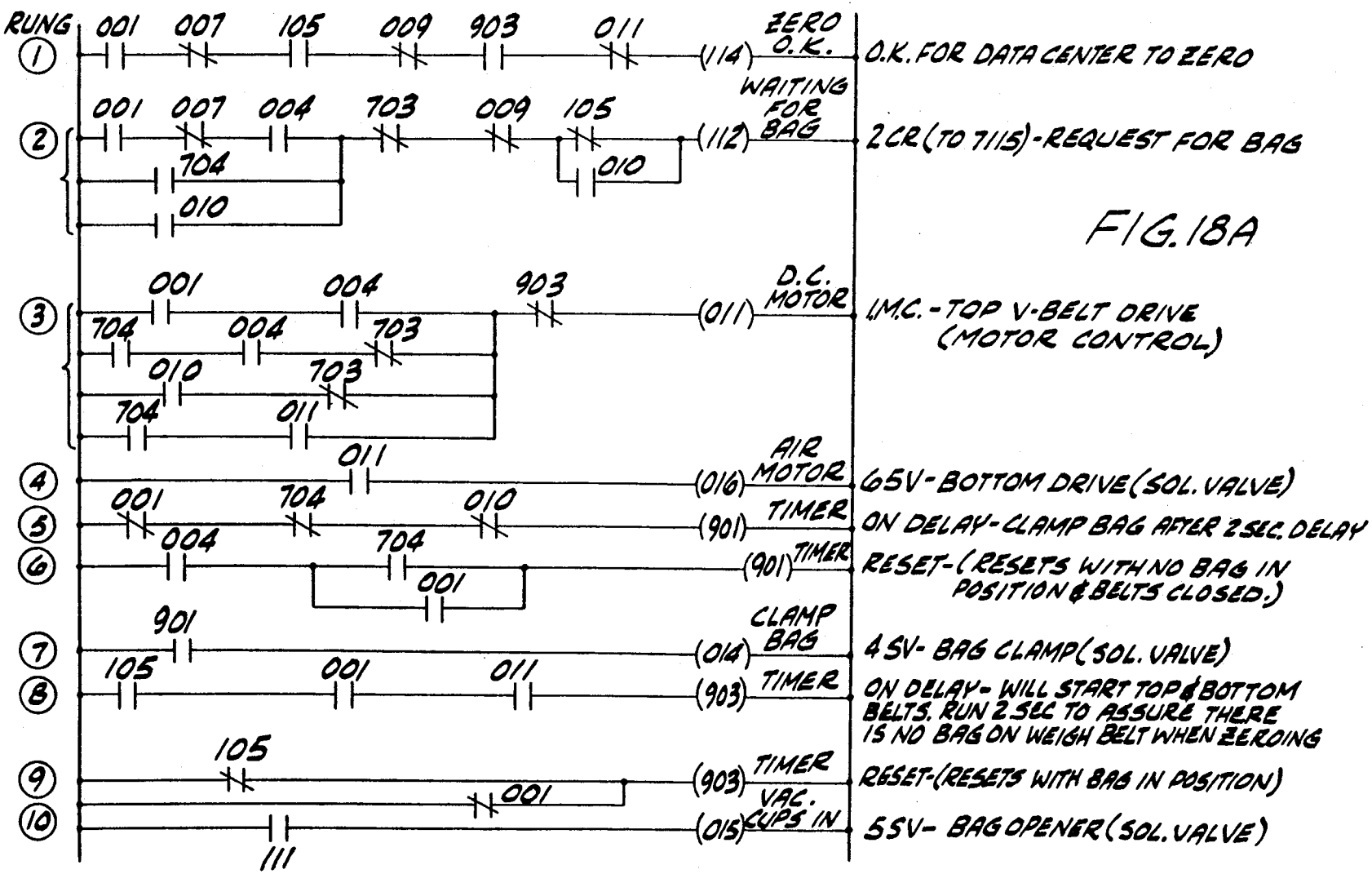
FIG. 18A is part of a ladder diagram serving as a flow chart re the programming of the apparatus.

Referring to FIG. 17, indicated at L1 and L2 are electric power lines supplied by a transformer 221. A vibrator control VC is connected in series with a vibrator coil 225 across lines L1 and L2 in a line 227. A controller 229 for the motor 167 for driving the belts 31 is connected across lines L1 and L2 in a line 231. A programmable controller 233, which may be an SLC 150 programmable controller sold by Allen-Bradley Company, Inc. of Milwaukee, Wisconsin is connected across the power lines in a line 235. The programming of this controller or processor is illustrated in FIGS. 18A and 18B. A 24 volt DC power supply unit 237 is connected across the power lines in a line 239. Unit 237 supplies DC power to a line 241 which includes a motor control relay MCR, a normally open start switch 243 and a normally closed stop switch 245. Contacts MCR1 of the relay MCR are connected in parallel with the start switch as indicated at 247. FIG. 14 also shows a line 249 having relay contacts 2CRa therein connected between a DC terminal #71 and a cycle stop terminal 71A of the auger filler unit 1.

Assuming that the auger filling unit 1 has been started and delivered product to a bag B, and that the bag closing apparatus 33 is on and the conveyors running; the start switch 243 is closed to start the top-off filling unit 23 in operation. The master control relay MCR is energized. A first tare is manually accomplished. A number of bags are run before the next zero cycle (the next tare) which may be programmed to take place by the controller 233. On closing the start switch 243, a 2CR relay in the controller 233 is energized, and the contacts 2CRa close, sending a signal to the auger filling unit 1 to deliver a bag. The top and bottom belts 31 and 57, respectively of the unit 23 start running. The bag B, with product therein and with its top position 17 flattened, is delivered by the unit 1 on to the upper reach of the belt conveyor 21 and transported by the latter to the trim or top-off filling position B2, the belt conveyor 21 stopping when the bag reaches this position by reason of interception by the bag of a beam of light to an electric stop eye IPE (see FIG. 1). As the bag is transported forward by the belt conveyor 21, its flattened top portion 17 is gripped between the forward-traveling inside reaches 31*a* of the upper belts 31 and fed forward thereby, the upper belts traveling at the same speed as the lower belts 57. A timer 901 in the controller 233 times out a short delay (e.g. 0.2 seconds) and then solenoid valve 4SV (see FIG. 16) is energized to actuate the corner gripper cylinders C4 to effect closure of the corner grippers 25 on the upper corners of the bag. The relay 2CR is deenergized to drop the "waiting for a bag" signal to the unit 1.

Figure 15:
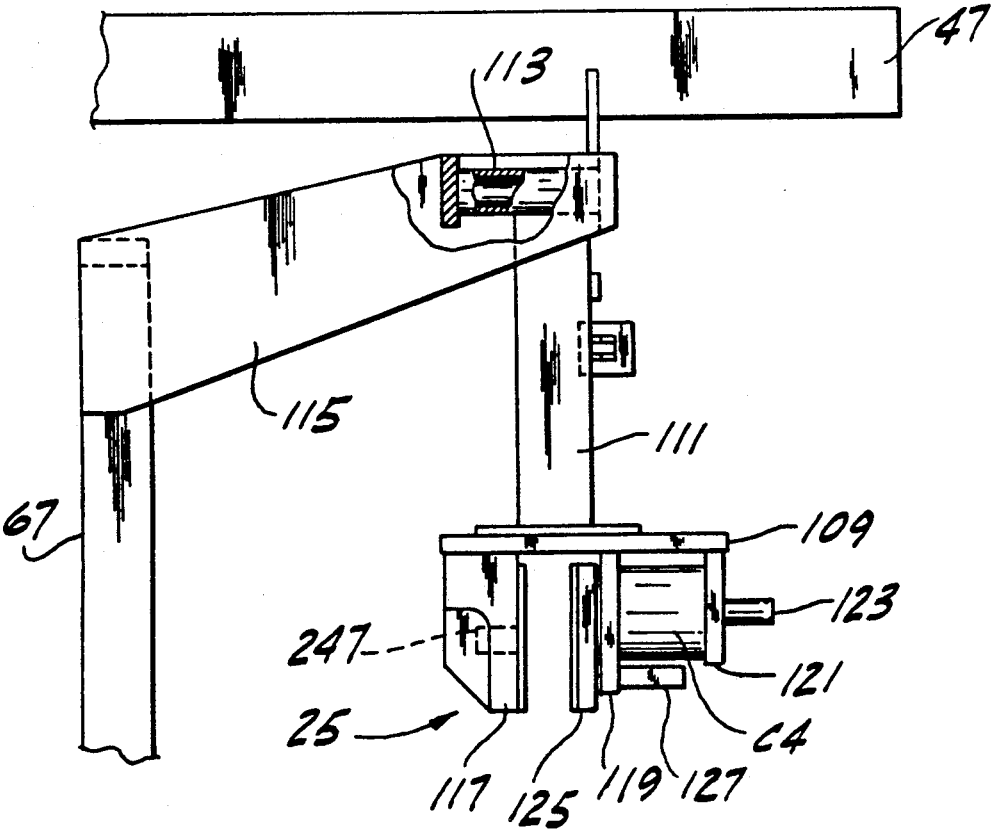
FIG. 15 is an end elevation of FIG. 14 with parts broken away and shown in section.

If there is a bag in proper position at B2, the closing of the corner grippers 25 functions to close no bag—no product switches indicated at 247 in FIG. 15. But if the bag is not in proper position, the switches 247 which may be identified as the "NBNP" switches are not closed, the operation is discontinued, and the bag, not being properly positioned, is removed or discharged manually. With the NBNP switches 247 closed, solenoid valve 7SV is energized, vacuum is drawn in the vacuum cups 27, and solenoid valve 5SV is energized to actuate cylinders to move the vacuum cups 27 inwardly toward one another to engage and vacuum grip the bag walls 5 and 7 adjacent the top of the bag. A timer 902 in the controller 233 times out a short delay (e.g. 0.4 seconds) to allow time for the vacuum cups to vacuum grip the bag, then energizes solenoid valve 1SV to actuate cylinder C1(?) to swing the upper belts 31 apart, thereby spreading the vacuum cups apart to pull the mouth of the bag open (see FIG. 8). Solenoid valve 3SV is simultaneously energized to actuate cylinder C3 to swing the bag corner grippers 25 inwardly toward one another to allow for the opening of the mouth.

When the upper belts 31 open, a proximity switch 2PR (see FIG. 12) is closed, and a ready-to-fill output 223 (see FIG. 12) signals the controller 233 that the bag at B2 is ready for being topped off. Solenoid valve 7SV is deactivated to turn off the vacuum to the vacuum cups 27 and discharge the air from an air chamber through the vacuum lines and vacuum cups. Solenoid 5SV is deactivated to deactivate cylinders C5 to retract the vacuum cups from the bag at position B2. With the cups thus opened, the controller 233 may check the bag weight for possible correction of the count of the revolutions of the auger of the unit.

The controller 233 then actuates solenoid valve 2SV to actuate cylinder C2 to open the vibrator cutoff gate 189 and energizes a relay (not shown) which has contacts 1CRa and which causes the vibrator control VC to turn on the vibrator motor 191 and vibrate the trough 187 to feed product (to dribble feed it) into the bag until the target weight is reached. The controller 233 programs in a maximum fill time that the vibrator motor may run and still have enough head space in the bag (above the product level) to provide enough bag top 17 for making a good bag closure. If this time is exceeded, the controller 233 stops the vibrator motor. Time is allowed for the machine operator to pat the bag and settle the product. The operator may then close a vibrator start switch, signalling the controller 233 to again start the vibrator motor.

When the target weight is reached, the vibrator motor 191 is stopped, and the solenoid valve 2Sv is deactivated to deactivate cylinder C2 and close the cutoff gate 189. The controller 233 then sends a "Fill Complete" signal to the unit 1 which results in actuation of relay 2CR to signal the unit 1 to deliver the next bag. Solenoid 1SV is deenergized to operate cylinder C1 to swing the upper belts to their closed position. Solenoid 3SV is deenergized to deactivate cylinder C3 to swing the corner grippers 25 outwardly away from one another to re-form the bag top. The ready to fill terminal 223 is deactivated.

When the upper belts 31 close on the re-formed bag top, a proximity switch 1PR closes; solenoid 4SV is deenergized and cylinder C4 is deactivated to deactivate cylinder C4 and open up the corner grippers 25. The air motor 71 is started to drive the belt conveyor 21 to transport the bag out of unit 23 from position B2 and into the closure unit 33, through which it is transported by a conveyor 33C. If the unit had been in a "Cycle Stop" condition, the belt conveyor would not have started until the "Start-Reset" switch is activated.

The cycle repeats when the next bag enters the unit 23 and cuts off the beam to the electric eye IPE. If the machine is stopped with the stop switch, all air will be dumped on the unit 23, and the bag may have to be removed manually (if there is a bag at the topoff position). If an "emergency stop" switch on the unit 1 is hit, all air on both units will be dumped. If a "pass-through" mode is selected, the formed bags from the unit 1 will not stop for topoff. The bags will pass through into the closure unit 33. If a "clean" mode is selected, a partially filled or empty bag will transfer to the topoff position and be opened, but the vibrator feed will be operator-controlled. The vibrator will run as long as the operator depresses a "vibrator start" switch. The operator may manually have to pat the bag, for there will be no settling as there would be if filled on unit 1. A "discharge" switch may be used to discharge a bag. It simulates an up-to-weight condition, reforms the bag, and transfers it to the closure unit 33. A "cycle stop" switch may be used to put the topoff unit 23 in a "hold" condition. A bag would be topped off and reformed, but would not pass out to the closure unit 33. To remove the "cycle stop" condition, a "start reset" switch would be pressed and normal cycling resumed.

Provision may be made for adjusting the conveyor 21 up and down relative to the weigh frame 67 for handling bags of different height, FIG. 1 showing two different possible positions. The adjustment may involve a rack and pinion mechanism, for example, operable by a crank such as indicated at 251 in FIG. 2.

It will be observed that the weighing system of the top-off unit 23 is essentially a platform weighing scale type of system, the conveyor 21 constituting the platform of the system, the weigh frame 67 constituting the support for the platform. The strain gage senses the deflection of the frame or support 67, and the weigh arm 87 as a measure of the weight supported by the frame or support 67. This weight as measured includes the weight of the corner grippers 25, but excludes the weight of the bag top constraining and feeding belts 31 and their supports 139 (which carry the vacuum cup cylinders C5), the belts being open at the time the top-off weight is determined. The supports 139 for the belts 31 are also the supports for the vacuum cup cylinders C5 and the vacuum cups 27, the cups being movable relative to the supports 139 (relative to crossbar 154) when the belts are in closed position between an advanced position engaging the bag walls and a retracted position (retracted a relatively short distance) outwardly from the plane 17A. The corner grippers 25 maintain the original flattened condition of the upper corners of the bag (the upper ends of the intucked gussets) when the bag is opened, and the belts 31 re-flatten the top portion of the bag and constrain it in the flattened condition upon their closing.

In view of the above, it will be seen that the several objects of the invention are achieved and other advantageous results attained.

As various changes could be made in the above constructions and methods without departing from the scope of the invention, it is intended that all matter contained in the above description or shown in the accompanying drawings shall be interpreted as illustrative and not in a limiting sense.

What is claimed is:

1. The method of packing gusseted open-mouth bags with a fluent solid product, each bag having opposed walls and gussets at the sides, the method comprising:

positioning an unopened bag in a first position for delivery of product into the bag by an auger filler.

gripping the upper corners of the bag to hold the gussets in their original condition at the top of the bag;

opening the mouth of the bag by pulling the walls of the bag apart between the gripped upper corners and moving the latter inwardly toward one another for allowing the opening of the mouth;

delivering into the opened bag an initial quantity of product weighing less than the final desired weight of product;

flattening the top portion of the bag above the level of product therein with said flattened top portion in a vertical plane extending between the walls of the bag.

releasing the grip on said upper corners of the bag and moving the bag forward in a predetermined path with its flattened top portion in said plane;

stopping the bag in a second position for delivery of additional product for completing the filling of the bag;

weighing the bag while in said second position to determine the additional amount of product needed to complete the filling of the bag;

gripping the upper corners of the bag in the second position to hold the gussets in their original condition at the top of the bag;

opening the mouth of the bag in the second position by pulling the walls of the bag apart between the gripped upper corners and moving the latter inwardly toward one another for allowing the opening of the mouth;

delivering said additional amount of product into the bag;

flattening the top portion of the bag above the level of product therein with said flattened top portion in said vertical plane; and releasing the grip on the upper corners of the bag and moving it further forward in said path for closing its flattened top portion.

2. The method of claim 1 wherein the flattened top portion of the bag is constrained in its flattened condition on release of the grip on its upper corners as it is moved forward to said second position.

3. The method of claim 2 wherein said flattened top portion of the bag is positively fed forward as it moves to said second position.

4. The method of claim 3 wherein the flattened top portion of the bag is constrained in its flattened condition and fed forward by engagement with opposite faces thereof of a pair of endless belts.

5. The method of claim 4 wherein the endless belts moved from an open to a closed position for the flattening of the top portion of the bag in the second position.

6. Apparatus for packing gusseted open-mouth bags with a fluent solid product, each bag having opposed walls and gussets at the sides, the apparatus comprising:

means for positioning an unopened bag in a first position for delivery of product into the bag by an auger filler;

means for gripping the upper corners of the bag to hold the gussets in their original condition at the top of the bag;

means for opening the mouth of the bag by pulling the walls of the bag apart between the gripped upper corners and moving the latter inwardly toward one another for allowing the opening of the mouth;

means for delivering into the opened bag an initial quantity of product weighing less than the final desired weight of product;

means for flattening the top portion of the bag above the level of product therein with said flattened top portion in a vertical plane extending between the walls of the bag;

means for releasing the grip on said upper corners of the bag and moving the bag forward in a predetermined path with its flattened top portion in said plane;

means for stopping the bag in a second position for delivery of additional product for completing the filling of the bag;

means for weighing the bag while in said second position to determine the additional amount of product needed to complete the filling of the bag;

means for gripping the upper corners of the bag in the second position to hold the gussets in their original condition at the top of the bag;

means for opening the mouth of the bag in the second position by pulling the walls of the bag apart between the gripped upper corners and moving the latter inwardly toward one another for allowing the opening of the mouth;

means for delivering said additional amount of product into the bag;

means for flattening the top portion of the bag above the level of product therein with said flattened top portion in said vertical plane; and means for releasing the grip on the upper corners of the bag and moving it further forward in said path for closing its flattened top portion.

7. Apparatus as set forth in claim 6 having means for constraining the flattened top portion of the bag in its flattened condition on release of the grip on its upper corners as it is moved forward to said second position.

8. Apparatus as set forth in claim 7 wherein said constraining means is operable positively to feed said flattened top portion of the bag forward as it moves to said second position.

9. Apparatus as set forth in claim 8 wherein the constraining means comprises a pair of endless belts.

10. Apparatus as set forth in claim 9 having means for moving the belts from an open to a closed position for the flattening of the top portion of the bag in the second position.

11. Apparatus for topping off the filling of a gusseted open-mouth bag with a fluent solid product, the bag having been filled with an initial quantity of product weighing less than the final desired weight of product and its top portion above the level of product therein being flattened, said apparatus comprising:

means for conveying the bag to a top-off position for delivery of additional product for topping off the bag and bringing it up to the final desired weight;

means for constraining the top portion of the bag in its flattened condition as it is conveyed to said position;

means for moving the constraining means between a closed position engaging and constraining said flattened top portion and an open position releasing said flattened top portion;

means for weighing the bag while in said top-off position with the constraining means open to determine the additional amount of product needed for the topping off;

a pair of grippers for gripping the upper corners of the bag in the top-off position to hold the gussets in their original condition at the top of the bag;

means for opening and closing said corner grippers;

means operable with the corner grippers closed and gripping the corners of the bag for opening the mouth of the bag in the top-off position by pulling the walls of the bag apart between the corner grippers;

means for moving the corner grippers toward and away from one another, operable to move the grippers inwardly toward one another with the constraining means open for allowing the opening of the bag mouth;

means for delivering said additional amount of product into the bag;

the means for opening and closing the corner grippers then being operable to move them outwardly away from one another and the means for moving the constraining means then being operable to close said constraining means for re-flattening the top portion of the bag;

the means for opening and closing the corner grippers then being operable to open them for operation of the conveying means to move the topped-off bag with its re-flattened top portion away from said top-off position.

12. Apparatus as set forth in claim 11 wherein said constraining means comprises a pair of endless belts and said apparatus has means for driving the belts for positive forward feed of the flattened top portion of the bag when the belts are in their closed position.

13. Apparatus as set forth in claim 12 wherein each belt is carried by a support mounted for swinging movement to swing the belts in and out.

14. Apparatus as set forth in claim 13 wherein the belts are driven by a motor mounted in fixed position and drive means for driving the belts from the motor including means allowing for the swinging of the supports.

15. Apparatus as set forth in claim 13 wherein the means for opening the mouth of the bag comprises vacuum cups carried by said supports movable in and out with the supports, and means for moving the vacuum cups relative to the supports between a closed position engaging the flattened top portion of the bag and a retracted open position.

16. Apparatus as set forth in claim 15 wherein the means for moving the vacuum cups relative to the supports comprises an air cylinder on each support with a vacuum cup on the piston rod of the cylinder.

17. Apparatus as set forth in claim 16 wherein the air cylinders are pivotally mounted on the supports and links are connected to the cylinders for maintaining them in a generally horizontal position as the supports swing in and out.

18. Apparatus as set forth in claim 11 having a frame, wherein the means for weighing the bag while in the top-off position comprises a support having an upper end and a lower end supporting the conveyor means as a scale platform adjacent its lower end, the conveyor support being pivoted at its upper end on the frame and having an arm the deflection of which is sensed as a measure of the weight carried by the support, including the weight of the bag on the conveyor means.

19. Apparatus as set forth in claim 11 wherein the means for delivering said additional amount of product comprises a vibratory feeder means.

20. Apparatus as set forth in claim 19 wherein said vibratory feeder is responsive to the weighing means and comprises a having a delivery end above the top-off position bag, and a cut-off gate for said delivery end of the trough.

* * * * *